US006238310B1

(12) United States Patent
Morrison

(10) Patent No.: US 6,238,310 B1
(45) Date of Patent: May 29, 2001

(54) TRACKER ARROW

(76) Inventor: Timothy Jon Morrison, 214 Senate Ave. Suite 303, Camp Hill, PA (US) 17011

( * ) Notice: Subject to any disclaimer, the term of this patent is extended or adjusted under 35 U.S.C. 154(b) by 0 days.

(21) Appl. No.: 09/569,502

(22) Filed: May 11, 2000

(51) Int. Cl.[7] ..... F42B 6/04
(52) U.S. Cl. ..... 473/581
(58) Field of Search ..... 473/578, 581, 473/FOR 216, FOR 218

(56) References Cited

U.S. PATENT DOCUMENTS

| | | | |
|---|---|---|---|
| Re. 33,470 | 12/1990 | Boy et al. | 342/386 |
| 2,909,372 | 10/1959 | Neri | 473/584 |
| 3,393,912 | 7/1968 | De Lonais | 473/581 |
| 3,617,060 | 11/1971 | Iezzi | 473/581 |
| 3,993,311 | 11/1976 | Johnson | 473/585 |
| 4,093,229 | 6/1978 | Kelling | 473/577 |
| 4,212,463 | 7/1980 | Repinski et al. | 473/581 |
| 4,252,325 * | 2/1981 | Weems et al. | 473/581 |
| 4,976,442 | 12/1990 | Treadway | 473/570 |
| 5,762,574 | 6/1998 | Mashburn | 473/581 |

* cited by examiner

*Primary Examiner*—John A. Ricci
(74) *Attorney, Agent, or Firm*—McNees, Wallace & Nurick; Carmen Santa Maria; Brian T. Sattizahn

(57) ABSTRACT

A hunting arrow having an elastomeric device attached to the inside of the hollow shaft of the hunting arrow is used for the tracking of game animals that have been struck with the hunting arrow. The elastomeric device attached to the inside of the hollow shaft can project beyond the body of the game animal and provide a conduit for the flow of blood of the game animal even after the remaining portion of the hunting arrow projecting from the game animal has been sheared off.

32 Claims, 4 Drawing Sheets

TRACKER ARROW

FIELD OF THE INVENTION

The present invention relates generally to hunting arrows and specifically to hunting arrows that permit a big game animal to be tracked by the hunter after being struck with the hunting arrow.

BACKGROUND OF THE INVENTION

During the hunting of big game animals, such as deer, elk, moose, bear, etc. with a bow and arrow, the game animal is usually not killed instantly after being struck with an arrow. Often the animal is still able to escape from the point of impact of the arrow by fleeing, thereby requiring the hunter to have to subsequently track the game animal. The hunter, in tracking the game animal, often uses the trail of blood left by the wound of the arrow as the primary way for tracking the game animal. The blood flows from the wound along the arrow shaft and drops onto the ground leaving a trail for the hunter to follow. However, when the game animal is fleeing the point of impact, the game animal will often break off a portion or portions of the arrow that protrudes from its body as it moves through trees or other brush. Of course, a portion of the arrow remains with the wounded animal after the protruding portion of the arrow snaps or breaks off. Before the arrow breaks off, as described above, a quantity of blood exits the animal by flowing along the length of the arrow protruding from the game animal to leave a blood trail for the hunter to follow. However, after the arrow is broken off, the blood trail can become scarce to the point of leaving no blood trail at all as the game animal's wound is closed by the fur, hide, fat and muscle tissue of the game animal, thereby reducing the amount of blood dropping to the ground, making it more difficult to, if not impossible to, track the wounded animal.

Several solutions have been attempted to make tracking the blood trail of the wounded game animal easier. U.S. Pat. No. 3,393,912 to De Lonais discloses a hunting arrow for tracking game hit by the arrow. The arrow is comprised of an imperforate rigid hollow shaft. The leading edge is provided with a broadhead. Behind the broadhead is a blood inlet means to permit blood to enter the hollow shaft. The trailing or rearward end is in communication with the hollow shaft and includes blood outlet means for discharging blood moving from the inlet to the outlet means. U.S. Pat. No. 2,909,372 to Neri is directed to an arrowhead with air openings between the blades that can be assembled to a shaft and that will cause sufficient bleeding to leave a blood trail to trace the wounded game. U.S. Pat. No. 4,212,463 to Repinski et al. discloses a humane hunting arrow designed to give the utmost amount of bleed-out possible in the shortest possible time. The arrow of this invention is comprised of an inner surface and an outer surface. The outer surface includes means formed thereon for facilitating the shearing of the shaft. These means may include a plurality of grooves formed on the inner or outer surface of the shaft. In a preferred embodiment, the broadhead and blade insert include a means for establishing a space between the animal tissue and the open end of the shaft to facilitate bloodflow thereinto. This space can be an aperture that permits the unrestricted flow of blood from the front to the rear portion of the arrow. The shaft is of relatively constant diameter and contains no diameter changes which serve as flow restrictions. The arrowhead is mounted on the shaft by means of a sleeve, and a broadhead is mounted to the sleeve.

Alternatively, U.S. Pat. No. 4,976,442 to Treadway discloses a technique for tracking a game animal by having a transmitter mounted in a hollow metal arrow. The transmitter is positioned within a notch in the arrow. The transmitter contains a barb which acts as an antenna and which lodges in an animal to terminally engage in the animal so that the animal may be tracked. Similarly, U.S. Pat. No. Re. 33,470 to Boy et al discloses an arrow having a hollow shaft into which is inserted a RF transmitter for tracking either the arrow or the game into which the arrow is affixed.

The above attempts at tracking wounded game animals have several disadvantages. First, the designs that leave a blood trail for tracking do not work effectively if the arrow is broken off inside the game animal's body, which usually occurs, as any blood that could flow from the wound would likely be absorbed by the fur of the game animal. Second, the designs that use transmitters can be difficult to operate, expensive to manufacture and may easily malfunction or become ineffective if the arrow is broken off.

What is needed is an improved device to facilitate the tracking of a large game animal wounded by an arrow by permitting a hunter to follow a trail of blood left by the fleeing animal.

BRIEF SUMMARY OF THE INVENTION

The hunting arrow of the present invention includes a hollow shaft having a first end and a second end. The first end of the hollow shaft is configured to receive a string nock and the second end of the hollow shaft is configured to receive an arrowhead. The string nock and arrowhead are attached to the ends of the hollow shaft. Near the first end of the hollow shaft and the string nock, at least one fin is attached to the outer surface of the hollow shaft to stabilize the arrow in flight. Inside the hollow shaft, an elongate elastomeric device is connected to the hollow shaft in an area in proximity to or adjacent the second end of the hollow shaft. The elongate elastomeric device is designed to extend inside the hollow shaft substantially between the first end and the second end.

In another embodiment of the present invention, the hollow shaft, near the end of the hollow shaft that receives the arrowhead, can have at least one aperture, but preferably has a plurality of apertures. Also, the elongate elastomeric device inserted in the hollow shaft is a tubular member having at least one aperture, but preferably also has a plurality of apertures, positioned substantially concentric or aligned with the apertures positioned near the end of the hollow shaft that receives the arrowhead.

A hunter using the hunting arrow of the present invention can preferably strike the game animal with the hunting arrow. Usually, a portion of the hunting arrow will project from the body of the game animal, as an arrow often will not pass completely through the game animal. If the game animal breaks off the portion of the hunting arrow that is projecting from the body of the game animal, the hunting arrow of the present invention can preferably continue to leave a blood trail for the hunter to follow. While the portion of the hunting arrow projecting from the game animal is broken off, the elongate elastomeric device that was attached to the inside of the arrow will still project from the body of the game animal. The projection of the elastomeric device from the game animal after the arrow has been broken off, can preferably keep the impact or entry wound from being closed over by the game animal's hide and fur and additionally can provide a path for the flow of blood along the outer surface of the elastomeric device away from the fur of the animal, thereby leaving a blood trail for the hunter to follow. Additionally, in the embodiment of the present invention where the elongate elastomeric device is hollow and the elastomeric device and the arrow shaft have openings therein, blood from the wounded game animal can flow into the openings and then flow both along the outer surface of the elongate elastomeric device and through the interior of the elastomeric device to leave a stronger blood trail for the hunter to follow and a potentially quicker bleed-out of the game animal.

One advantage of the present invention is that it can leave a blood trail for the hunter to follow after a game animal breaks off a protruding hunting arrow. Another advantage of the present invention is that it can be used with almost any hollow, hunting arrow on the market today for relatively minimal cost.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Whenever possible, the same reference numbers will be used throughout the figures to refer to the same parts.

DETAILED DESCRIPTION OF THE INVENTION

Figure 1:
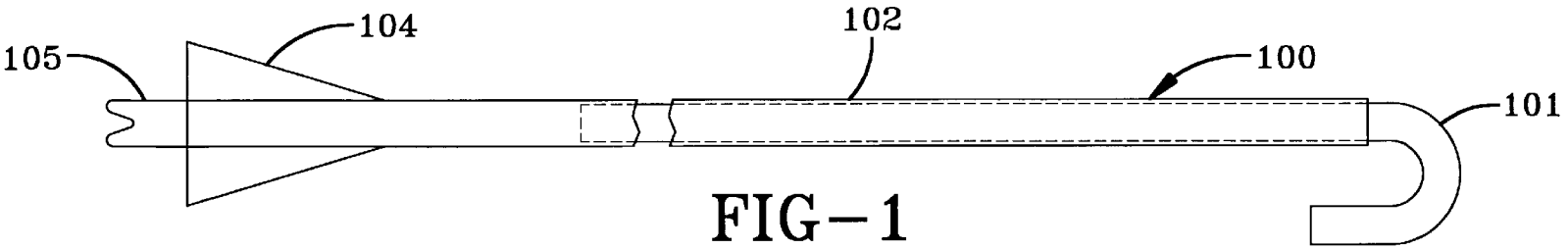
FIGS. 1–4 illustrate the steps involved in assembling the hunting arrow of the present invention.

FIGS. 1–4 illustrate the steps involved in one possible way of assembling the hunting arrow 100 of the present invention. First, the assembly of the hunting arrow 100 of the present invention begins with the obtaining of a hollow shafted hunting arrow. Any type of hollow shafted hunting arrow can be used in the assembly of the hunting arrow 100 of the present invention. These hollow shafted arrows usually are tubing made from extruded aluminum or aluminum alloy. However, the hunting arrow 100 can be manufactured from any substantially sturdy material, including other metal alloys, rigid plastics or graphite. The hunting arrow 100 preferably has a hollow shaft 102 and at least one fin or feather 104, commonly referred to as the fletching, attached substantially adjacent to or in proximity to one end of the hollow shaft 102 on the outer surface of the hollow shaft 102. The fletching 104 is used to stabilize the flight of the hunting arrow 100 through the air towards a target. At the same end of the hunting arrow 100 as the fletching 104, a string nock 105 is connected to the hollow shaft 102. The string nock 105 can preferably receive a corresponding string of a hunting bow and can be either rigidly connected to the hollow shaft 102 or can be detachably connected to the hollow shaft 102. At the other end of the hunting arrow 100, an arrowhead 103 is detachably connected to the hollow shaft 102. The arrowhead 103 is preferably a broadhead, but other types of hunting arrowheads can be used.

Next, as shown in FIG. 1, a flexible, lightweight and non-absorbent material or device is inserted or placed inside the hollow shaft 102 of the hunting arrow 100. While any flexible. lightweight and non-absorbent material or device can be inserted in the hollow shaft 102, the flexible, lightweight and non-absorbent material or device inserted in the hollow shaft 102 is preferably an elastomeric material or device 101. The elastomeric device 101 is preferably inserted into the hollow shaft 102 at the end of the hunting arrow 100 that receives the arrowhead 103. However, in another embodiment of the present invention having a detachably connected string nock 105, the elastomeric device 101 can be inserted into the hollow shaft 102 from either end of the hunting arrow 100. The elastomeric device 101 is preferably inserted into substantially the entire length of the hollow shaft 102. Other lengths of elastomeric device 101 can also be inserted into the hollow shaft 102, but the length of the elastomeric device 101 must be sufficiently long in order for a portion of the elastomeric device 101 to project or protrude from the body of the game animal after a portion of the hunting arrow 100 is sheared or broken off. Additionally, the length of the elongate elastomeric device 101 is preferably not longer of greater than the length of the hollow shaft 102. When placed in the hollow shaft 102, the elastomeric device 101 should extend for at least two-thirds of the length of the hollow shaft 102. The elastomeric device 101 is preferably a non-absorbent, lightweight, flexible material. The elastomeric device 101 is preferably a plastic material such as a polyethylene, a polypropylene, a polytetrafluoroethylene (PTFE) and the like, however, the elastomeric device 101 can also be a rubber material or any other material that is non-absorbent, lightweight and flexible. The specific type of elastomeric material used is not a limiting factor, as long as it is sufficiently strong that it will not be damaged as it flexes on contact with trees and other brush, will not break from fatigue as it is flexed a multiple number of times, is lightweight and is non-absorbent.

Figure 2:
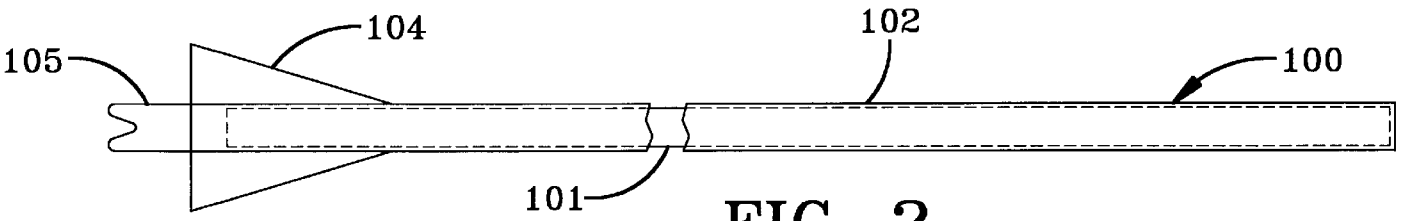

FIG. 2 illustrates that the elastomeric device 101 is preferably cut or trimmed to the appropriate length, which length is described in greater detail above, after being inserted into the hollow shaft 102. In a preferred embodiment, the elastomeric device 101 is preferably cut to a length that permits insertion of the arrowhead 103 into the end of the hollow shaft 102. Alternatively, in another embodiment, the elastomeric device 101 can be pre-cut to an appropriate preselected length, as described in greater detail above, that can easily be inserted into the hollow shaft 102 and still permit insertion of the arrowhead "Insert tap" 103 into the end of the hollow shaft 102.

Figure 3:
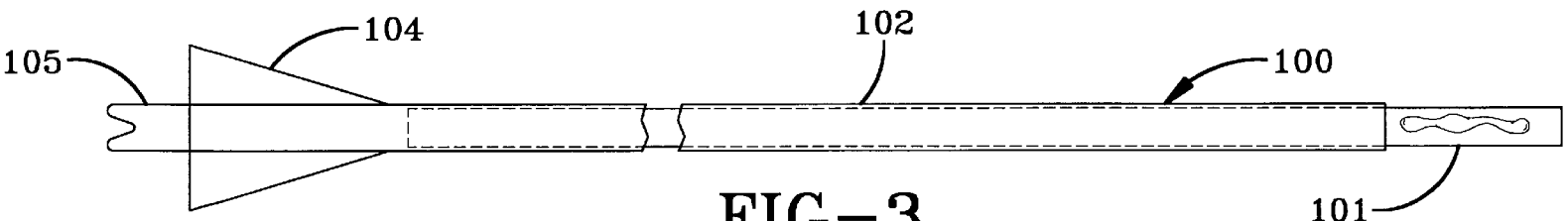

FIG. 3 illustrates that a portion of the elastomeric device 101 is then withdrawn from the hollow shaft 102 at the end that receives the arrowhead 103 and the outer surface of the elastomeric device 101 is then preferably coated with an adhesive. While any type of adhesive that is not fluid soluble may be used to affix the elastomeric device 101 to the hollow shaft 102, the preferred adhesives include epoxy and a series of adhesives manufactured by Lord Corporation of Erie, Pa. for adhering elastomeric materials to metal, and that are sold under the trade name of CHEMLOK®. Preferably, about three to four inches of the outer surface of the elastomeric device 101 is coated with the adhesive at one end. After the adhesive is applied to the elastomeric device 101, the elastomeric device 101 is reinserted into the hollow shaft 102 to attach the elastomeric device 101 to the inner surface of the hollow shaft 102 using the adhesive. In another embodiment, if the elongate elastomeric device 101 has been pre-cut to an appropriate preselected length, the adhesive could be applied to the elastomeric device 101 and the elastomeric device 101 with the adhesive could be inserted into the hollow shaft 102 in a single step. Preferably, the elastomeric device 101 has a diameter that is slightly smaller than the inside diameter of the hollow shaft 102 in order to permit the adhesive to make contact with an bind to the inner surface of the hollow shaft 102. In another embodiment, the elastomeric device 101 has a hollow or tubular shape and a tool can be inserted in the tubular elastomeric device 101 and used to expand the elastomeric device 101 and force the adhesive on the outer surface of the elastomeric device 101 to bind with the inner surface of the hollow shaft 102.

In addition to the use of the adhesive, other techniques can be used to attach or connect the elastomeric device 101 to the inner surface of the hollow shaft 102. The hollow shaft 102 of the hunting arrow 100 can be designed to have a smaller diameter at the end of the hollow shaft 102 that receives the arrowhead 103, and a string nock 105 that is detachable from the hollow shaft 102. The smaller diameter of the hollow shaft 102 can be used to form a frictional connection between the inner surface of the hollow shaft 102 and the elastomeric device 101. In addition, the smaller diameter of the hollow shaft 102 can also be used to form a better adhesive connection between the elastomeric device 101 and the inner surface of the hollow shaft 102. Alternatively, one end of the elastomeric device 101 could be manufactured with a larger diameter than at the other end and then inserted at the end of the hollow shaft 102 that receives the arrowhead 103. The elastomeric device 101 with one end having a larger diameter than at the other end can also be used for a frictional connection or a better adhesive connection between the elastomeric device 101 and the inner surface of the hollow shaft 102. The hollow shaft 102 can also be crimped to hold the elongate elastomeric device 101 in the hollow shaft 102.

In another embodiment, the elongate elastomeric device 101 can also be joined by heating at least a portion of the hollow shaft 102 with the elongate elastomeric device 101 positioned within to a temperature sufficiently high to at least partially melt the elongate elastomeric device 101. On cooling, the elastomeric material can bond to the inner diameter of the hollow shaft 102. When the elongate elastomeric device 101 is tubular in shape or a type of tubing, cooling air can be circulated through the interior of the elongated elastomeric device 101 to prevent complete melting and sealing of the tubing of the elastomeric device 101, if desired.

In still another embodiment, the elongate elastomeric device 100 can be connected or attached to the hollow shaft 102 in area in substantially proximity to the middle of the hunting arrow 100. The attachment of the elongate elastomeric device 101 to the hollow shaft 102 in proximity to the middle of the hunting arrow 100 can be accomplished using any of the techniques described above. The attachment of the elongate elastomeric device 101 in proximity to the middle of the hunting arrow 100 can be in addition to or in lieu of the connection of the elastomeric device at the end of the hollow shaft 102 that receives the arrowhead 103. This embodiment can be used to provide blood trail using the elastomeric device 101, where the arrowhead end of the hunting arrow passes through the game animal and is subsequently broken off.

Figure 4:
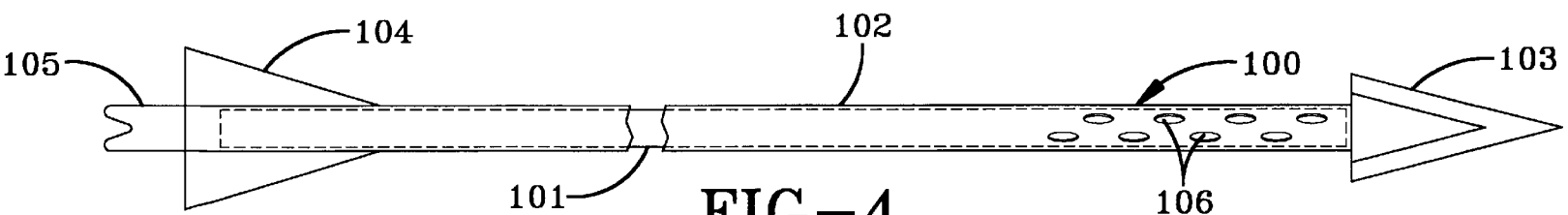

FIG. 4 illustrates the attachment of the elastomeric device 101 to the inner surface of the hollow shaft 102 with the adhesive coating and the connection of the arrowhead 103 to the hollow shaft 102. Additionally, in a preferred embodiment, the elastomeric device 101 is hollow and has a tubular shape. The tubular shape is preferable as it reduces the weight of the elongate elastomeric device 101. The tubing thickness should be as thin as possible to minimize the weight of the hunting arrow 100, while retaining the previously described properties of strength, flexibility and fatigue resistance. It is desirable to minimize the weight so that the aerodynamics of the hunting arrow 100 are minimally affected.

The hollow shaft 102 and the elastomeric device 101 can each have several perforations, apertures or openings 106 therein, preferably concentric or aligned, for receiving the blood of the game animal that has been struck with the hunting arrow 100. The apertures or perforations 106 in the hollow shaft 102 and elastomeric device 101 preferably extend for eight to ten inches from the arrowhead 103 toward the first end or the nock end. In addition, the perforations or openings 106 in the elastomeric device 101 and the hollow shaft 102 are preferably at an angle in order to minimize the perforations 106 impact on the aerodynamics and flight path of the hunting arrow 100.

Figure 5:
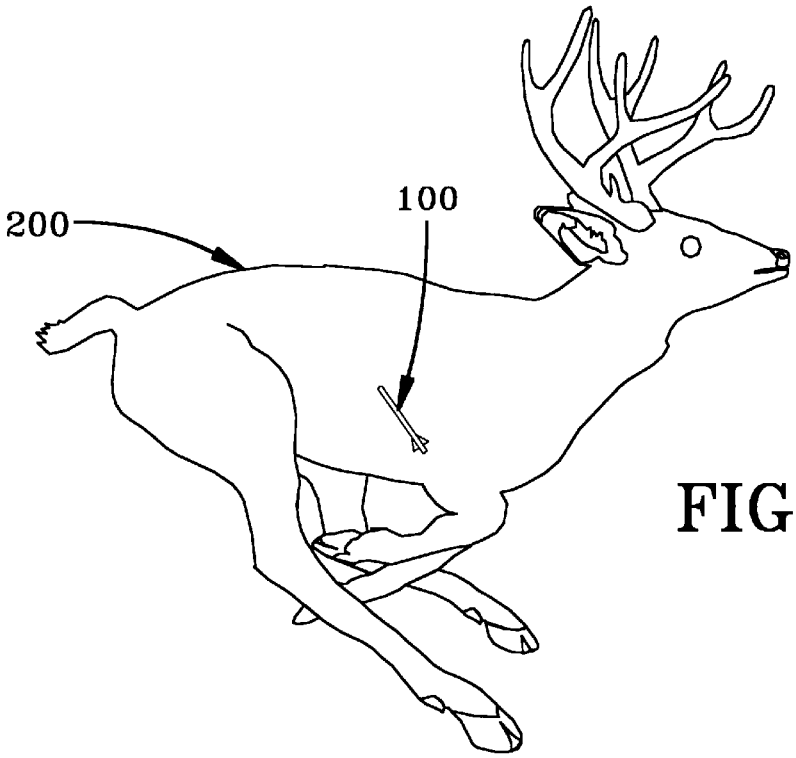
FIGS. 5–8 illustrate how the hunting arrow of the present invention operates after impacting a game animal.
Figure 6:
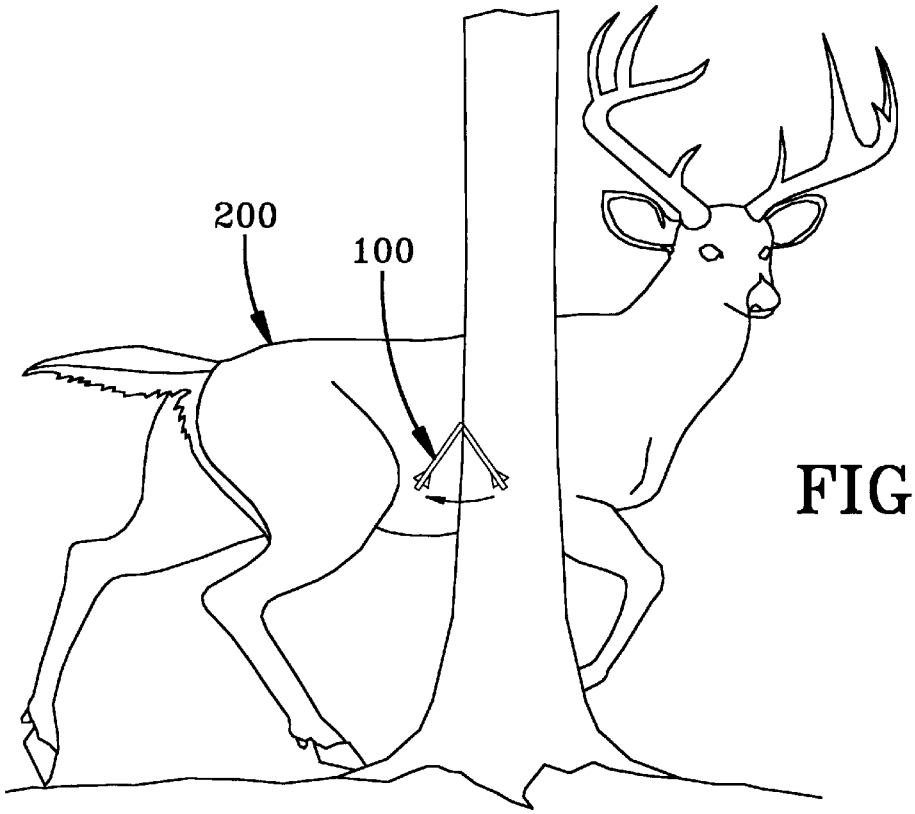

FIGS. 5–8 illustrate how the hunting arrow 100 of the present invention can leave a blood trail for the hunter to follow after striking the game animal with the hunting arrow 100. In FIG. 5, a game animal 200 is struck or impacted with the hunting arrow 100. The hunting arrow 100 preferably does not pass completely through the game animal 200 and thus leaves a portion of the hunting arrow 100 projecting or protruding from the body of the game animal 200. As the game animal 200 flees the point of impact of the hunting arrow 100, the game animal 200 typically travels close to trees and heavy brush as shown in FIG. 6. The contact with the trees and heavy brush can break or shear off the portion of the hunting arrow 100 that is projecting from the body of the game animal 200. The shearing off of the hunting arrow 100 usually involves the breaking off of the hollow shaft 102 inside the body of the game animal 200. It is not necessary for the hunting arrow 100 to break to track the game animal, as the blood can flow along the tubular portion of the hunting arrow 100 and drop to the ground.

Figure 7:
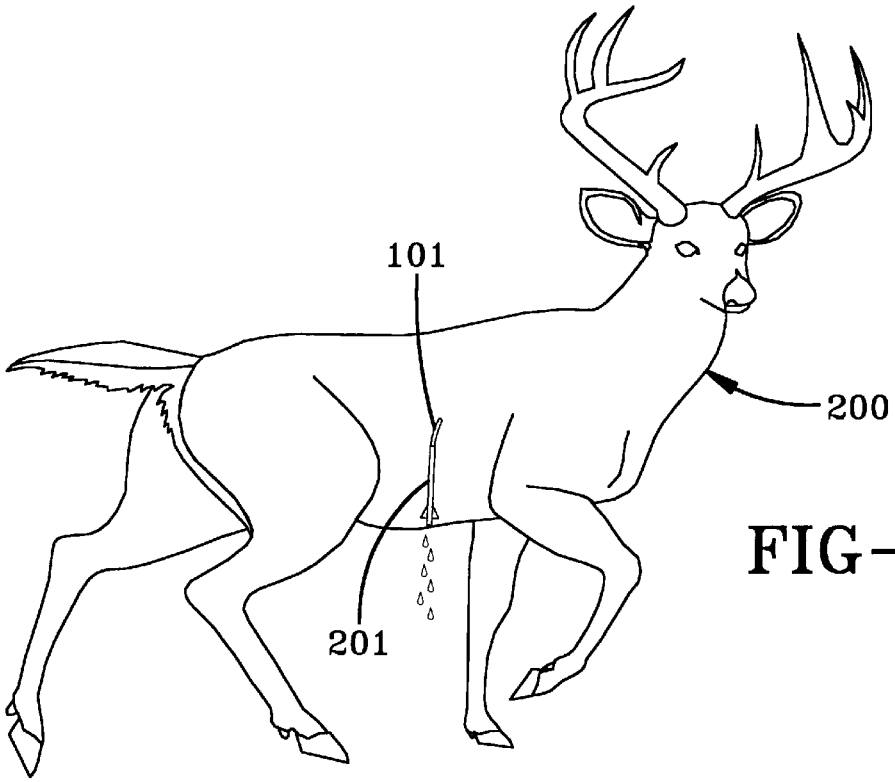

However, after the portion of the hunting arrow 100 projecting from the body of the game animal 200 has been sheared off, the sheared or broken off portion of the hunting arrow 201 can preferably slide or travel down the elastomeric device 101 as shown in FIG. 7. Depending on how the hunting arrow 100 is sheared off, the sheared off portion of the hunting arrow 201 may or may not be able to slide completely off the elastomeric device 101 and fall to the ground.

Figure 8:
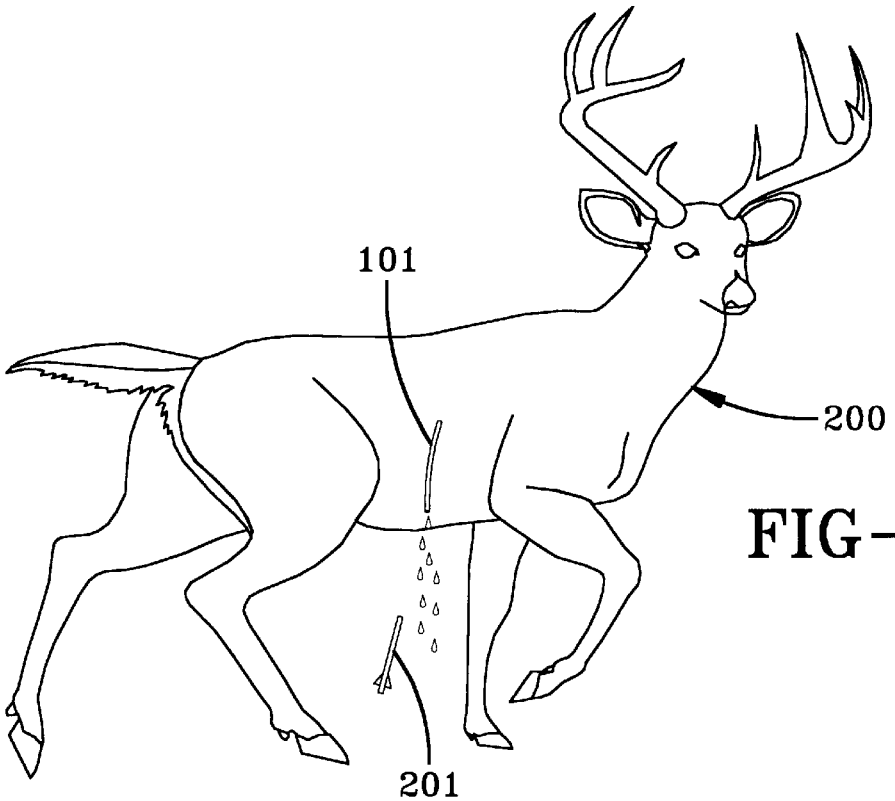

Regardless of whether or not the sheared off portion of the hunting arrow 201 falls to the ground, the elastomeric device 101 will preferably still project from the body of the game animal 200 because the elastomeric device 100 is attached or connected to the inner surface of the hollow shaft 102 of the portion of the hunting arrow 100 that remains inside of the body of the game animal 200. As shown in FIG. 8, the sheared off portion of the hunting arrow 201 slides completely off the elastomeric device 101 and falls to the ground. The projection of the elastomeric device 101 from the body of the game animal 200 after the hunting arrow 100 has been sheared or broken off can preferably prevent the impact wound of the hunting arrow 100 from closing up and thereby permit blood to continue to flow out of the body of the game animal 200. Preferably, the blood can flow along the outer surface of the elastomeric device 101, using the elastomeric device 101 as a conduit or path, and away from the fur of the game animal, thereby leaving a blood trail for the hunter to track.

In another preferred embodiment, the elastomeric device 101 has tubular or hollow shape and blood can flow through the inside of the elastomeric device 101, in addition to having blood be able to flow along the outer surface of the elastomeric device 101. The blood in the internal cavity of the game animal 200 enters the elastomeric device 101 through openings 106 in the hollow shaft 102 and the elastomeric device 101 due to the pumping and capillary action by the internal organs of the game animal 200 as it flees. Then, the blood can flow through the inside of the elastomeric device 101 that projects from the body of the game animal 200 to the outside and thereby create a siphoning effect. This additional path for blood to flow from the game animal 200 can preferably leave a stronger or more visible trail for the hunter to track and also provide for a faster bleed-out of the game animal 200.

Figure 9:
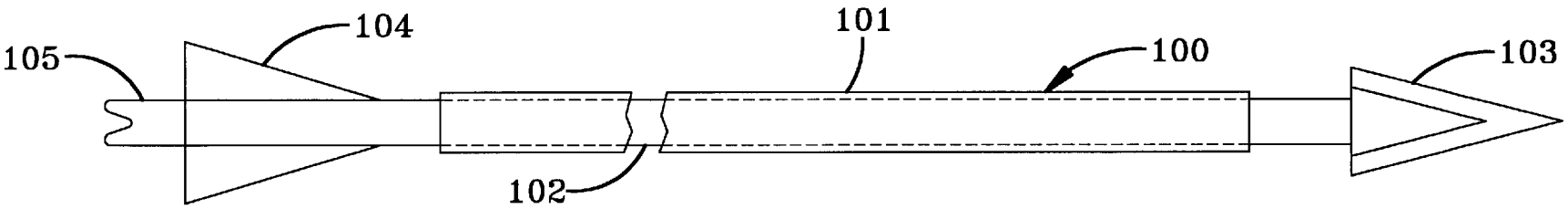
FIG. 9 illustrates an alternate embodiment of the present invention.

In another embodiment of the present invention illustrated in FIG. 9, a hollow elongate elastomeric tube 101 having a diameter about the same size as the diameter of the arrow shaft 102, but preferably slightly larger or equal to the diameter of the arrow shaft 102, is assembled over the arrow shaft 102. The elastomeric device 101 can be fastened to the exterior of the arrow shaft 102 in the same manner that the elastomeric device 101 is attached to the interior of the arrow shaft 102. In operation, as the animal flees, the arrow 100 will break in the same manner, but will not fall to the ground. The broken portion of the arrow 100 will probably dangle or hang from the animal, prevented from falling by the flexible elastomeric tube 101 around the outside of the arrow shaft 102. The blood will flow along the exterior of the tube 101 and fall to the ground in the same manner as previously set forth.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. A hunting arrow comprising:

a hollow shaft having a first end and a second end and a central axis extending between said first end and said second end;

a string nock attached to said first end of said hollow shaft;

at least one fin attached to said hollow shaft adjacent said first end of said hollow shaft;

an arrowhead connected to said second end of said hollow shaft; and an elastomeric device positioned inside said hollow shaft and attached to said hollow shaft adjacent to said arrowhead, said elastomeric device extending within said hollow shaft toward said first end of said hollow shaft and having a length no greater than said hollow shaft.

2. The hunting arrow of claim 1 wherein said elastomeric device comprises a tubular member.

3. The hunting arrow of claim 2 wherein said hollow shaft includes at least one aperture having a central axis at an angle to the central axis of said hollow shaft.

4. The hunting arrow of claim 3 wherein said tubular member includes at least one aperture substantially aligned with said at least one aperture of said hollow shaft.

5. The hunting arrow of claim 4 wherein:

said at least one aperture in said tubular member includes a plurality of apertures in said tubular member;

said at least one aperture in said hollow shaft includes a plurality of apertures in said hollow shaft aligned with the plurality of apertures in said tubular member; and said plurality of apertures in said tubular member and said plurality of apertures in said hollow shaft are positioned from about 0.5 to 10 inches from said arrowhead.

6. The hunting arrow of claim 1 wherein said elastomeric device is attached to said hollow shaft using an adhesive.

7. The hunting arrow of claim 6 wherein the adhesive is positioned within said hollow shaft adjacent to said arrowhead between said hollow shaft and said elastomeric device for about 3 to 4 inches.

8. The hunting arrow of claim 1 wherein said elastomeric device is attached to said hollow shaft using a heating method to melt at least a portion of said elastomeric device, wherein said melted at least a portion of said elastomeric device bonds to said hollow shaft on cooling.

9. The hunting arrow of claim 1 wherein said elastomeric device comprises a flexible, lightweight, non-absorbent plastic tube.

10. The hunting arrow of claim 1 wherein said elastomeric device extends substantially completely between said first end of said hollow shaft and said second end of said hollow shaft.

11. A method for tracking the blood trail of a game animal comprising the steps of:

impacting the game animal with an arrow having a hollow shaft and an elastomeric device positioned within the hollow shaft, the elastomeric device being attached to the hollow shaft;

projecting a portion of the arrow from the game animal to provide a path for blood to flow from the game animal;

shearing off the portion of the arrow projecting from the game animal and exposing the elastomeric device outside of the game animal; and providing a path along the exposed elastomeric device for blood to flow from the game animal.

12. The method of claim 11 wherein the step of providing a path along the exposed elastomeric device comprises providing a path along the exterior surface of the elastomeric device for blood to flow from the game animal.

13. The method of claim 12 wherein the elastomeric device is a plastic tube and the step of providing a path along the exposed elastomeric device further comprises providing a path along the interior surface of the plastic tube for blood to flow from the game animal.

14. A method of assembling a hunting arrow having a string nock at one end and an arrowhead at the other end, the method comprising the steps of:

providing a hollow shafted arrow with an open end to receive one of the arrowhead and the string nock;

inserting an elastomeric device into the open end of the hollow shafted arrow;

attaching the elastomeric device to the hollow shafted arrow; and sealing the open end of the hollow shafted arrow with said one of the arrowhead and the string nock.

15. The method of claim 14 further comprising the step of cutting the elastomeric device to a preselected length.

16. The method of claim 14 wherein the step of attaching the elastomeric device to the hollow shafted arrow comprises applying an adhesive to the elastomeric device.

17. The method of claim 14 wherein the step of attaching the elastomeric device comprises attaching the elastomeric device to the hollow shafted arrow adjacent to the end of the hollow shafted arrow having the arrowhead.

18. The method of claim 14 wherein the elastomeric device is a plastic tube and further comprising the step of perforating both the hollow shafted arrow and the plastic tube substantially adjacent to the end of the hollow shafted arrow having the arrowhead.

19. The method of claim 18 wherein the step of perforating both the hollow shafted arrow and the plastic tube comprises perforating both the hollow shafted arrow and the plastic tube at an angle to maintain appropriate aerodynamics of the hollow shafted arrow.

20. The method of claim 14 wherein the step of attaching the elastomeric device to the hollow shafted arrow comprises applying a heating method to the hollow shafted arrow to melt at least a portion of the elastomeric device, wherein the melted at least a portion of the elastomeric device bonds to the hollow shafted arrow on cooling.

21. A hunting arrow comprising:

a hollow shaft having a first end and a second end and a central axis extending between said first and said second end;

a string nock attached to said first end of said hollow shaft;

at least one fin attached to said hollow shaft adjacent said first end of said hollow shaft;

an arrowhead connected to said second end of said hollow shaft; and a flexible, lightweight, non-absorbent tube positioned inside said hollow shaft and attached to said hollow shaft adjacent to said arrowhead, said flexible, lightweight, non-absorbent tube extending within said hollow shaft toward said first end of said hollow shaft and having a length no greater than said hollow shaft.

22. The hunting arrow of claim 21 wherein said second end of said hollow shaft includes at least one aperture having a central axis at an angle to the central axis of said hollow shaft.

23. The hunting arrow of claim 22 wherein said flexible, lightweight, non-absorbent tube includes at least one aperture substantially aligned with said at least one aperture of said second end of said hollow shaft.

24. The hunting arrow of claim 21 wherein said flexible, lightweight, non-absorbent tube comprises an elastomeric tube.

25. The hunting arrow of claim 21 wherein said flexible, lightweight, non-absorbent tube is connected to said hollow shaft using an adhesive.

26. The hunting arrow of claim 25 wherein the adhesive is positioned within said hollow shaft adjacent to said arrowhead between said hollow shaft and said flexible, lightweight, non-absorbent tube for about 3 to 4 inches.

27. The hunting arrow of claim 21 wherein said flexible, lightweight, non-absorbent tube extends substantially completely between said first end of said hollow shaft and said second end of said hollow shaft.

28. A hunting arrow comprising:

a hollow shaft having an interior surface, an exterior surface, a first end and a second end;

a string nock attached to said first end of said hollow shaft;

at least one fin attached to said exterior surface of said hollow shaft adjacent said first end of said hollow shaft;

an arrowhead connected to said second end of said hollow shaft; and an elastomeric tube attached to one of said interior surface of said hollow shaft and said exterior surface of said hollow shaft adjacent to said arrowhead, said elastomeric tube extending toward said first end of said hollow shaft and having a length no greater than said hollow shaft.

29. The hunting arrow of claim 28 wherein said elastomeric tube is attached to said exterior surface of said hollow shaft.

30. The hunting arrow of claim 29 wherein said elastomeric tube is attached to said hollow shaft using an adhesive.

31. The hunting arrow of claim 29 wherein said elastomeric tube extends substantially completely between said first end of said hollow shaft and said second end of said hollow shaft.

32. The hunting arrow of claim 29 wherein said elastomeric tube is attached to said exterior surface of said hollow shaft using a heating method to melt at least a portion of said elastomeric device, wherein said melted at least a portion of said elastomeric device bonds to said hollow shaft on cooling.

* * * * *